United States Patent [19]

Casey

[11] Patent Number: 5,065,891

[45] Date of Patent: Nov. 19, 1991

[54] REMOVABLE OR FIXED INNER RING DEVICE FOR TRASH RECEPTACLE LINERS

[76] Inventor: Robert G. Casey, 7853 Blue Gray Cir., Manassas, Va. 22110

[21] Appl. No.: 554,446

[22] Filed: Jul. 19, 1990

[51] Int. Cl.[5] ..... B65D 67/04

[52] U.S. Cl. ..... 220/404; 220/908; 248/99; 248/101

[58] Field of Search ..... 220/908, 404, 482; 248/99, 101

[56] References Cited

U.S. PATENT DOCUMENTS

| | | | |
|---|---|---|---|
| 134,637 | 1/1873 | Brown | 248/99 |
| 832,251 | 10/1906 | Gipple | 248/101 |
| 1,643,407 | 9/1927 | Florance | 220/404 |
| 2,092,969 | 9/1937 | Gustafson et al. | 220/65 |
| 2,678,764 | 5/1954 | Carlson | 226/129 |
| 3,148,799 | 9/1964 | Meroney | 220/404 |
| 3,204,866 | 9/1965 | Brighton et al. | 248/101 |
| 3,522,922 | 8/1970 | Byron et al. | 248/101 |
| 3,627,243 | 12/1971 | Farrelli | 248/99 |
| 3,807,598 | 4/1974 | Nutt | 220/908 |
| 3,815,778 | 6/1974 | Martin | 220/65 |
| 3,927,786 | 12/1975 | Aboud | 220/63 |
| 4,122,973 | 10/1978 | Ahern | 220/404 |
| 4,294,379 | 10/1981 | Bard | 220/404 |
| 4,312,531 | 1/1982 | Cross | 294/55 |
| 4,715,572 | 12/1987 | Robbins, III. et al. | 248/101 |
| 4,765,579 | 8/1988 | Robbins, III. et al. | 248/101 |
| 4,834,260 | 5/1989 | Auten | 220/404 |
| 4,856,675 | 8/1989 | Palazzola | 220/404 |
| 4,867,340 | 9/1989 | Byers | 220/404 |
| 4,913,308 | 4/1990 | Culbertson | 220/404 |
| 4,934,637 | 6/1990 | Guerrera | 248/101 |
| 4,940,201 | 7/1990 | Kurth | 248/101 |

FOREIGN PATENT DOCUMENTS

| | | | |
|---|---|---|---|
| 168438 | 6/1951 | Austria | 248/99 |

*Primary Examiner*—Stephen Marcus
*Assistant Examiner*—S. Castellano
*Attorney, Agent, or Firm*—Oblon, Spivak, McClelland, Maier & Neustadt

[57] ABSTRACT

A fixed or removable inner ring device for supporting a flexible bag liner inside a trash receptacle is configured in such a manner as to provide air gaps or vent spaces between the inner ring and the inside of the trash container, thereby enabling release of trapped air upon insertion of a flexible bag liner into the trash container. Additionally, the ring device permits the use of different sized of liner bags and provides for a neat appearance by eliminating unsightly overhang of the liner top outside the trash container.

3 Claims, 6 Drawing Sheets

REMOVABLE OR FIXED INNER RING DEVICE FOR TRASH RECEPTACLE LINERS

BACKGROUND OF THE INVENTION

1. Field of the Invention

The present invention relates to a removable or fixed inner ring device for supporting a flexible bag liner inside a trash receptacle.

2. Description of the Related Art

In conventional trash receptacles having a plastic trash bag, a problem occurs when filling the trash bag in that the air trapped between the bag and the receptacle prevents the bag from assuming a proper configuration.

A further problem with conventional trash receptacles is that they are not readily adaptable to different size plastic trash bags.

Finally, in a conventional trash bag, if an oversized plastic bag is used, the top of the bag has to be hung over the top of the receptacle thereby creating an unsightly appearance.

SUMMARY OF THE INVENTION

Accordingly, one object of this invention is to provide for a novel inner ring device for supporting a flexible bag liner inside a trash receptacle. The inner ring device can either be removable with respect to an existing trash receptacle or can be an integral part of the trash receptacle.

A further object of the present invention is to provide for an inner ring which is configured in such a manner as to provide for air gaps or vent spaces between the ring and the inside of the trash container, thereby enabling release of trapped air upon insertion of a flexible bag liner into the trash container, and preventing collapse of the bag upon loading it with refuse.

A further object of the present invention is to provide for an inner ring device which permits the use of different sizes of liner bags and provides for a neat appearance by eliminating unsightly overhang of the liner top outside the trash container.

A further object of the invention is to provide for a removable inner ring device which is selectively adjustable in size to thereby fit into various trash receptacles having different sizes.

The inner ring mechanism of the present invention is for supporting a flexible bag liner inside a trash receptacle, the trash receptacle having a main body with a closed bottom and an open top with a rim, the inner ring comprising means for mounting the inner ring on the rim of the receptacle, wherein the inner ring is disposed within an upper portion of the receptacle and has a diameter slightly smaller than the diameter of the receptacle; and flared portions defined on predetermined positions along the circumference of the inner ring, wherein gaps for venting air are disposed along the circumference of the inner ring between the flared portions, thereby enabling a release of trapped air upon insertion of the flexible bag liner into the receptacle, the flared portions extending outwardly toward the main body of the receptacle; wherein an opening is defined between the inner ring and the mounting means, such that a top portion of the bag liner can be inserted within the opening when the inner ring is mounted within the receptacle and the bag liner is inserted into the trash receptacle, thereby supporting the bag liner and preventing the bag liner from overhanging on the exterior of the receptacle.

The present invention also relates to an inner ring mechanism which comprises mounting means for mounting the inner ring within an upper portion of the receptacle wherein the inner ring has a diameter slightly smaller than the diameter of the receptacle, with the mounting means comprising a plurality of flared portions which abut against an inwardly extending bench portion on the main body of the receptacle, the flared portions being located on predetermined positions along the circumference of the inner ring, wherein gaps for venting air are defined along the circumference of the inner ring between the flared portions, thereby enabling a release of trapped air upon insertion of the bag liner in the receptacle; the inner ring, the flared portions and a top edge portion of the main body of the receptacle defining an opening for the insertion of a top portion of the bag liner when the bag liner is inserted into the receptacle, thereby supporting the bag liner and preventing the bag liner from overhanging on the exterior of the receptacle.

Finally, the present invention relates to a trash receptacle comprising an inner ring positioned slightly below the rim of the receptacle and having a diameter which is slightly smaller than the diameter of the open top of the receptacle, the inner ring being integral with the main body of the receptacle and defining open gaps at predetermined positions along the circumference of the inner ring, thereby enabling a release of trapped air when a flexible bag liner is insert into the receptacle, wherein the inner ring and an upper portion of the main body of the trash receptacle define an opening for the insertion of a top portion of the bag liner when the bag liner is inserted into the receptacle.

BRIEF DESCRIPTION OF THE DRAWINGS

A more complete appreciation of the invention and many of the intended advantages thereof will be readily obtained as the same becomes better understood by reference to the following detailed description when considered in connection with the accompanying drawings, wherein:

FIG. 1(*b*) is a top view of the trash receptacle and inner ring of FIG. 1(*a*);

FIG. 1(*c*) is a view of a portion of the edge of the receptacle and a portion of the inner ring of the present invention;

FIG. 1(*d*) shows the inner ring and the receptacle of the present invention;

FIG. 7(*a*) is a top view of the inner ring mechansim of FIG. 7;

DESCRIPTION OF THE PREFERRED EMBODIMENTS

Figure 1A:
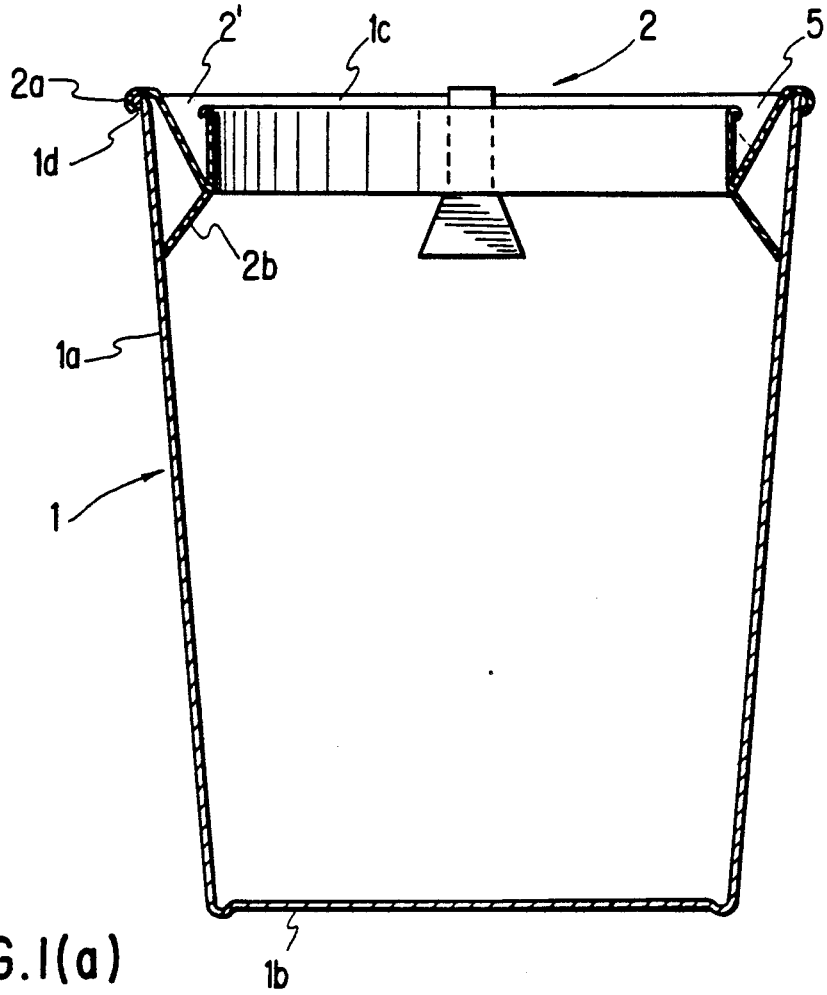
FIG. 1(*a*) is a view of an existing trash receptacle and the inner ring mechanism of the present invention.
Figure 1B:
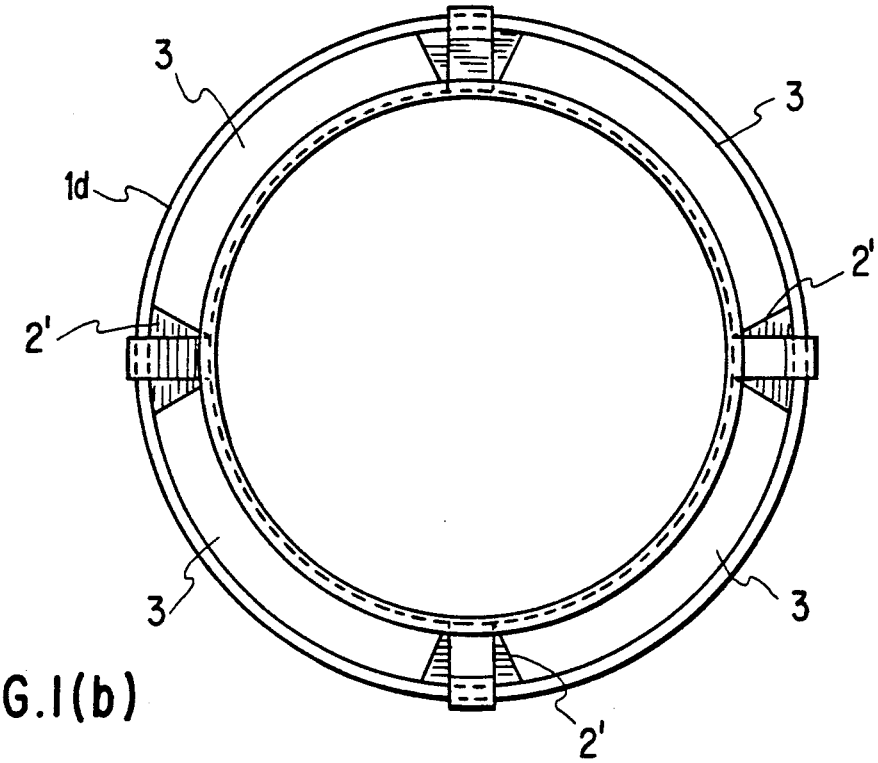
Figure 1C:
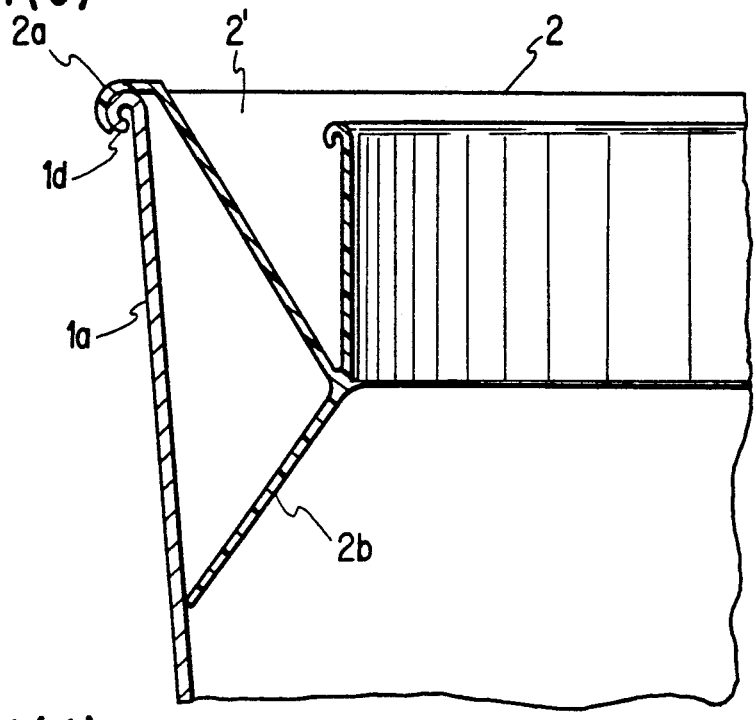
Figure 1D:
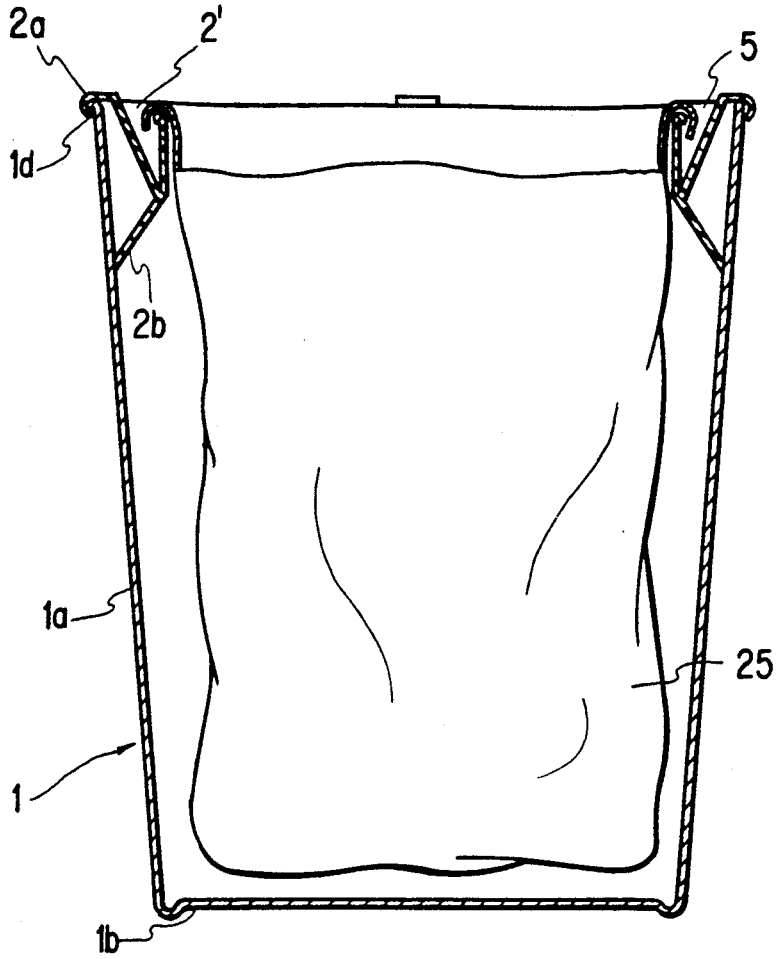

Referring now to the drawings, wherein like reference numerals designate identical or corresponding parts throughout the several views, and more particularly to FIG. 1(*a*) thereof, FIG. 1(*a*) illustrates a trash receptacle 1 having an inner ring mechanism 2 mounted thereon. The trash receptacle 1 comprises a main body 1*a* having a closed bottom end 1*b*, and an open top shown generally at 1*c*. The receptacle further comprises a rim 1*d*. As shown in FIGS. 1(*a*)–1(*c*), the inner ring 2 of the present invention comprises a plurality of fastening mechanisms 2' which define hook portions 2*a* which mount onto the rim 1*d*of the trash receptacle 1 and flared portions 2*b* which extend outwardly towards the main body 1*a* of the trash receptacle 1. As further illustrated in FIG. 1(*b*), the fastening mechanisms 2' are disposed along the circumference of the inner ring 2 at predetermined positions. With this arrangement, air gaps 3 are created between each of the fasteners 2', thereby enabling release of trapped air upon insertion of a flexible bag liner 25 into the trash receptacle.

As shown in FIGS. 1(*a*)–1(*c*), the inner ring 2 is mounted within the trash receptacle 1, such that the hook mechanisms 2*a* of each of the fasteners 2', are mounted along the rim 1*d*of the trash receptacle 1. Thereafter, the flexible bag liner 25 is inserted into the bag and the top portions of the bag can be tucked away into an opening 5 created between the inner ring 2 and the hook means 2*a*. Thus, during use, the air can be vented out through the gaps 3 and a neat appearance is created by eliminating the unsightly overhang of the liner top outside the trash can since the liner top is inserted within the opening 5 as shown in FIG. 1(*d*).

The inner rim mechanism of the present invention is adaptable to both metal and plastic trash receptacles and the inner ring itself can be made of any plastic or vinyl material.

Figure 2:
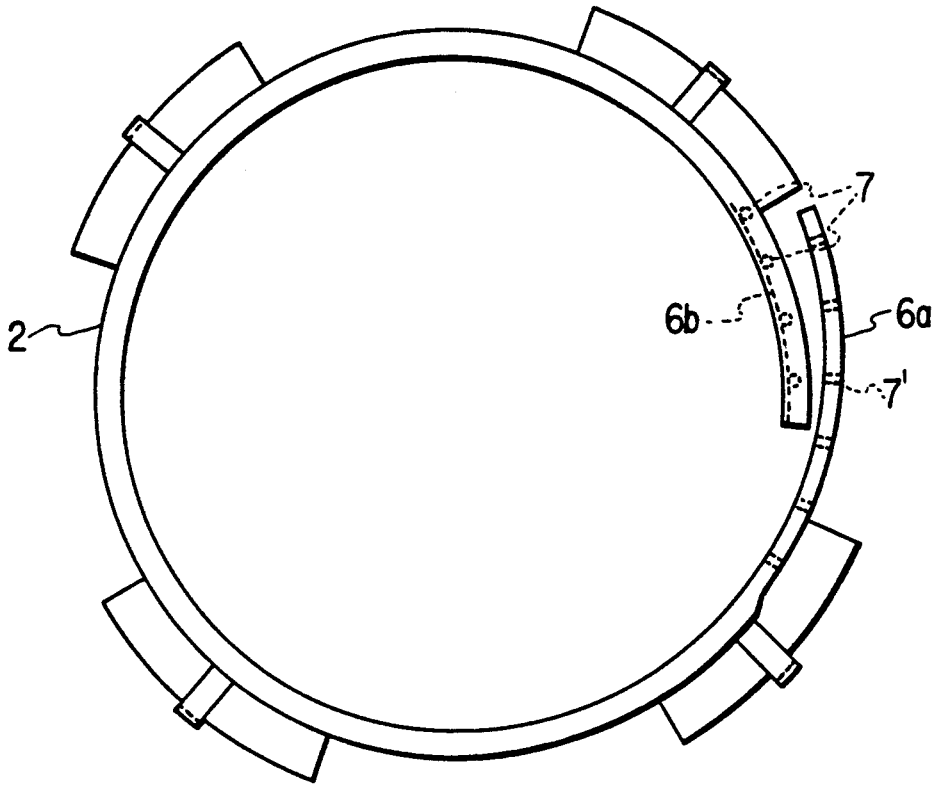
FIG. 2 shows a top view of the adjustable inner ring of the present invention.
Figure 3A:
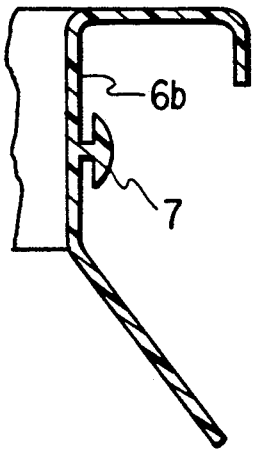
FIGS. 3(*a*), 3(*b*), 3(*c*) and 3(*d*) show the detail of the adjusting mechanism for adjusting the size of the inner ring.
Figure 3B:
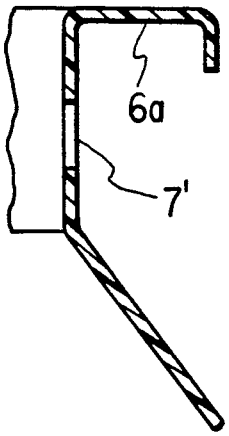

FIG. 2 shows the adjusting mechanism for adjusting the circumferential size of the inner ring mechanism 2 of the present invention. As shown in FIG. 2, the inner ring can be provided with a slit along the entire vertical length of the inner ring, thereby providing for an open ring having overlapping end portions 6*a* and 6*b*. As shown in FIG. 2 and further illustrated in FIG. 3(*a*), one of the overlapping end portions 6*b* is provided with a plurality of projecting snaps 7 which extend towards the other of the overlapping end portions 6*a*. The overlapping end portion 6*a* is provided with a plurality of slots 7' as shown more clearly in FIGS. 3(*b*), 3(*c*) and 3(*d*) which are adapted to receive the projecting snaps 7. Of course, the invention is not limited to the shown configuration and the position of the slots 7' and the projecting snaps 7 can be reversed. In use, when the overlapping end portion 6*a* is positioned adjacent the overlapping portion 6*b*, the slots 7' are selectively lined up with predetermined projection snaps 7, and the snaps are inserted into the slots 7' to thereby adjust the circumferential size of the inner ring mechanism 2. As shown in FIGS. 3(*c*) and 3(*d*), the positioning of the slots 7' can be varied and basically depends on the desired sizing of the adjustable inner ring mechanism.

Figure 4:
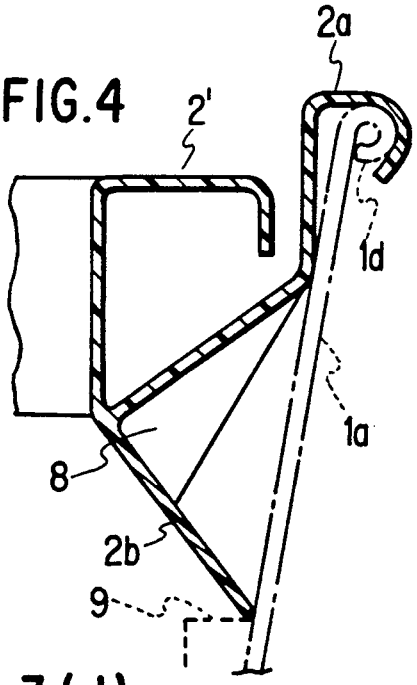
FIG. 4 is an isolated view of the mounting mechanism of the inner ring of the present invention.
Figure 3C:
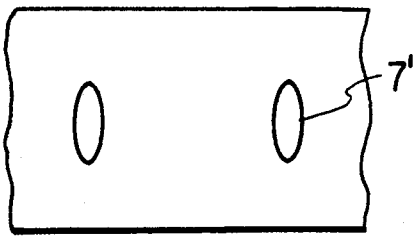
Figure 3D:
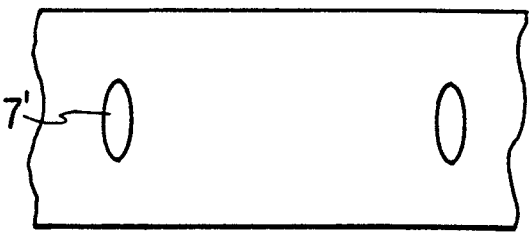

FIG. 4 shows an isolated view of the fastening mechanism 2'. As shown in FIG. 4, the hook means 2*a* of the fastening mechanism can be provided with a wide stability rib 8 to provide added stability to the inner ring mechanism 2 when the inner ring mechanism is mounted on the trash receptacle 1. Additionally, as further shown in FIG. 4, if the trash receptacle 1 is provided with an inwardly extending bench portion 9, the flared portion 2*b* can abut against the inwardly extending bench portion 9 as shown in FIG. 4, to provide added stability to the inner ring.

Figure 5:
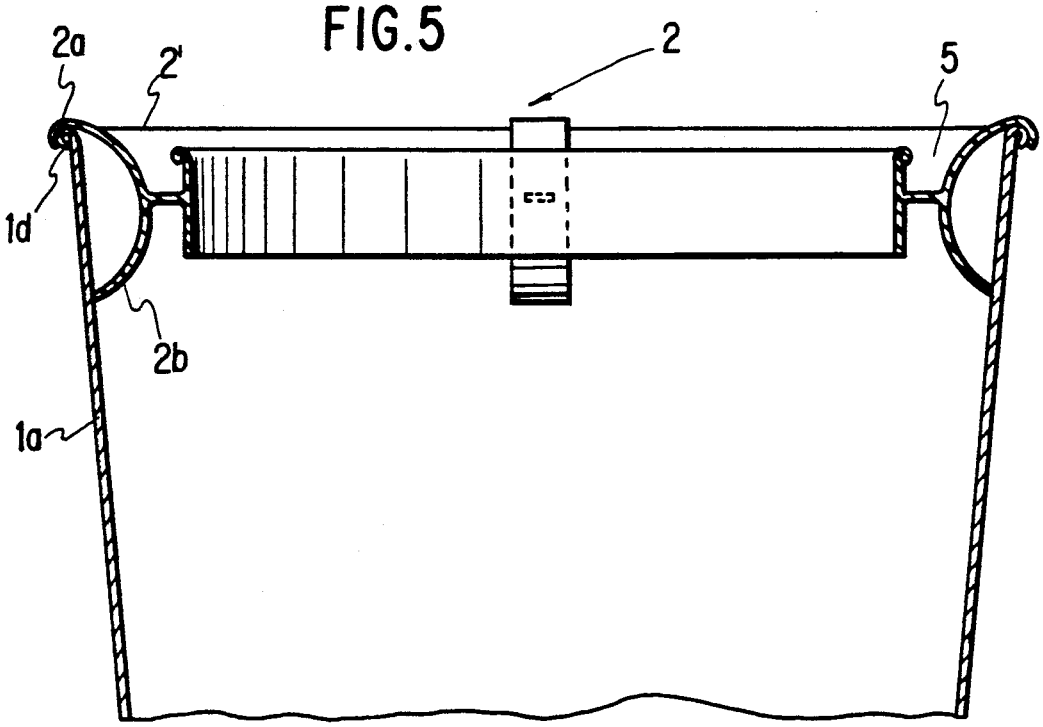
FIG. 5 is a view of another embodiment of the inner ring mechanism of the present invention.
Figure 6:
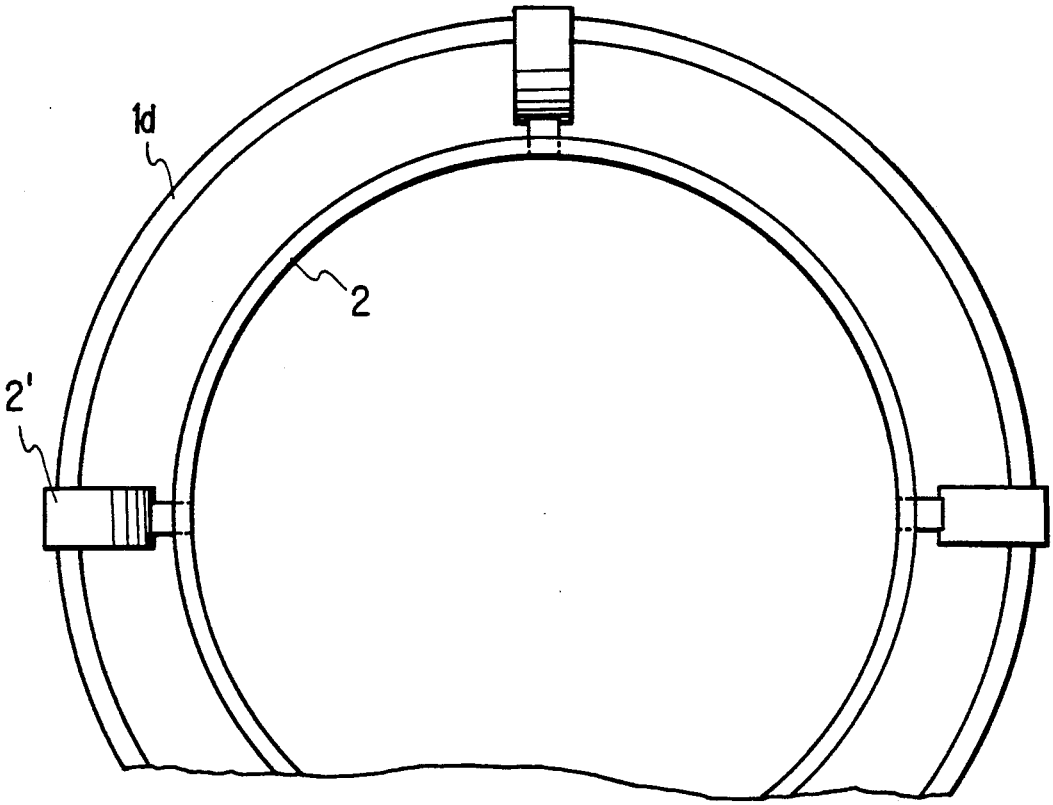
FIG. 6 is a top view of the inner ring mechansim of FIG. 5.

FIGS. 5 and 6 show a further embodiment of the inner ring mechanism of the present invention. In FIG. 5, the fastening means 2' is "C" shaped and hooks onto the top portion of the trash receptacle in a similar fashion to the embodiment of FIG. 1(*a*).

Figure 7:
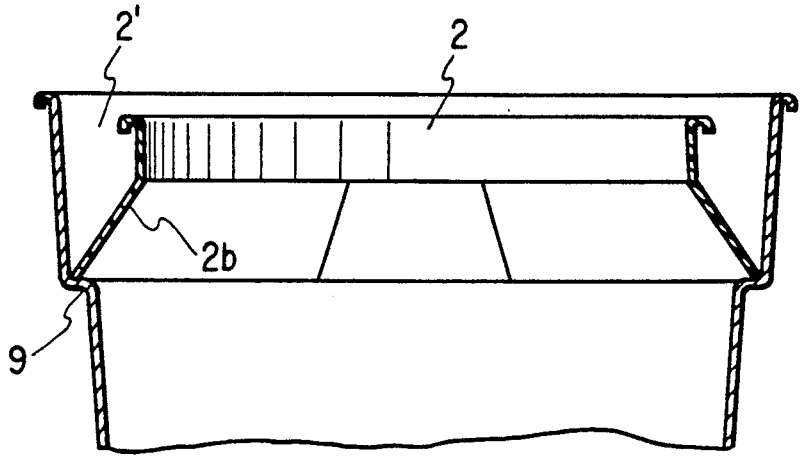
FIG. 7 shows a view of a further embodiment of the inner ring mechanism of the present invention.
Figure 7A:
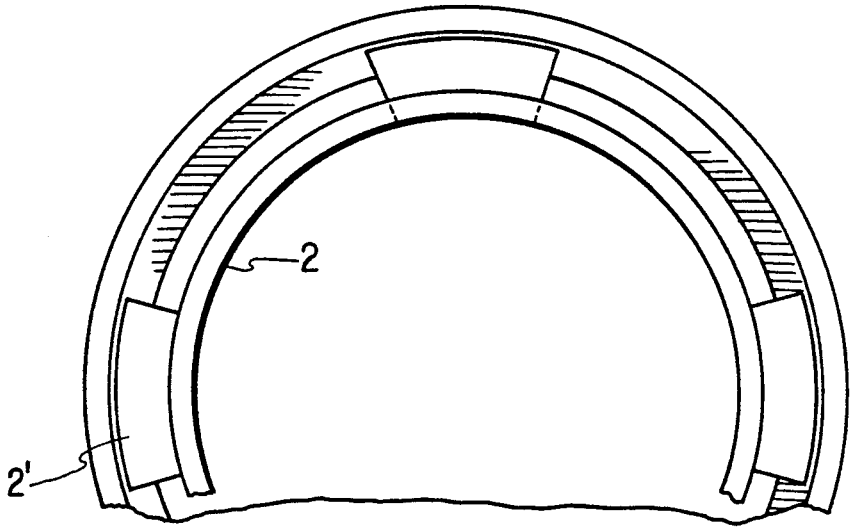
Figure 8:
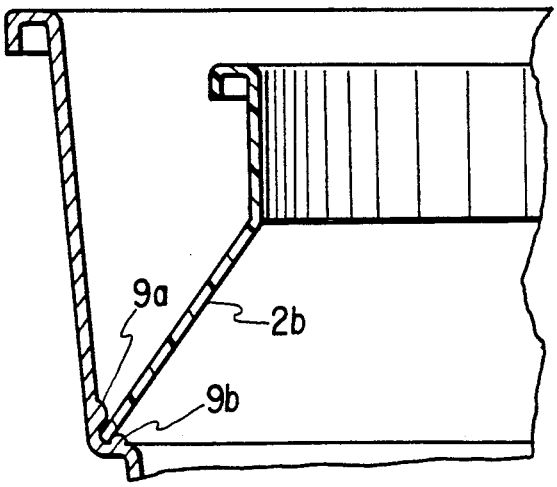
FIG. 8 is an isolated view of a section of the inner ring mechanism as shown in FIG. 7(*a*)
Figure 8:
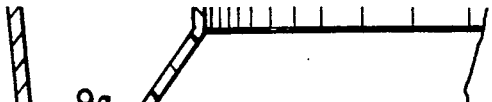

FIGS. 7, 7(*a*) and 8 show a further embodiment of the inner ring mechanism of the present invention. In FIG. 7, the removable inner ring 2 comprises only the outwardly extending flared portions 2*b*. This embodiment can be used in trash receptacles having the inwardly extending bench portion 9. As shown in FIG. 7 and in more detail in FIG. 8, the flared portions 2*b* abut against the inwardly extending bench portion 9 to thereby support the inner ring mechanism within the trash receptacle 1. The details of the remaining elements of FIG. 7 is similar to the embodiment of FIG. 1(*a*) and thus further explanation is not believed to be necessary. Additionally, please note that as shown in FIG. 8, the trash receptacle may include knobs 9*a* and 9*b* which are located on the inwardly extending bench portion 9 and the main body of the trash receptacle 1. If a trash receptacle having knobs is utilized, the inwardly extending flared portions 2*b* can be snapped in between the knobs 9*a* and 9*b* to provide added stability to the inner ring mechanism 2.

Figure 9:
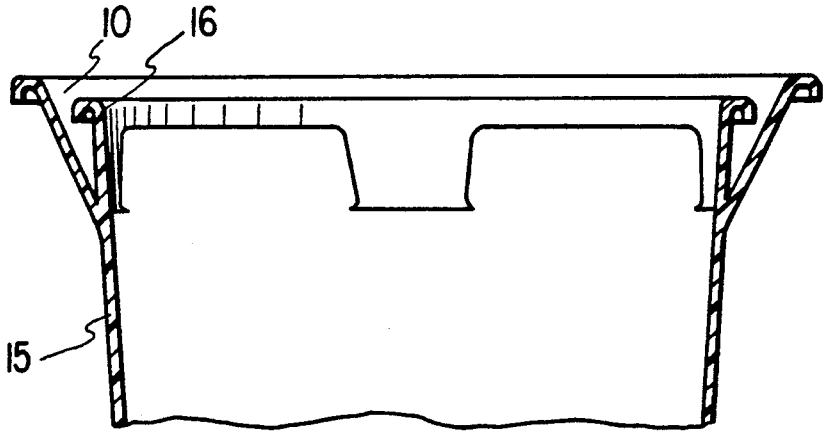
FIG. 9 is a view of a trash receptacle of the present invention having a fixed inner ring.
Figure 10:
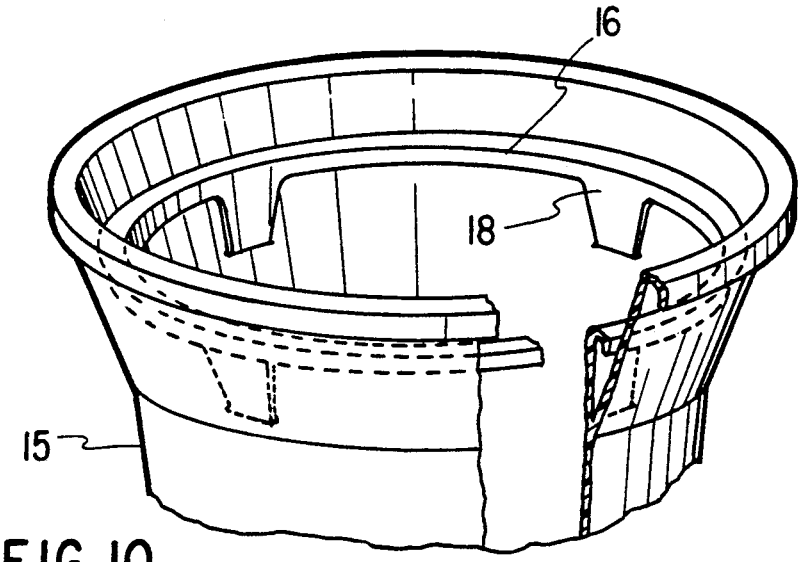
FIG. 10 shows the inner ring mechanism and trash receptacle of FIG. 9.
Figure 11:
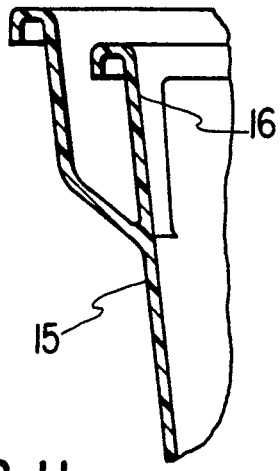
FIGS. 11 and 12 are isolated views of a section of the inner ring and trash receptacle shown in FIG. 9.
Figure 12:
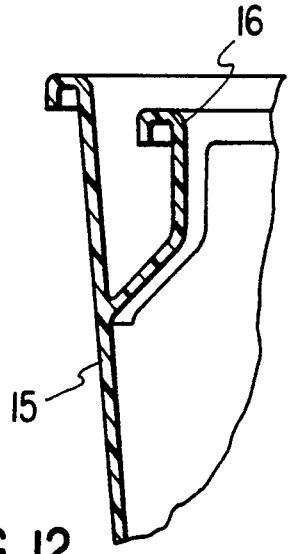

FIGS. 9 and 10 show a trash receptacle 15 of the present invention having a fixed inner ring 16. The above mentioned trash receptacle can be manufactured by any well known molding means and comprises the inner ring 16 being integral with the main body of the trash receptacle 15. In the inner ring of FIGS. 9 and 10, solid portions 18 are disposed along predetermined circumferential positions of the inner ring 16 to provide for the venting of air when a trash bag is inserted within the receptacle. Additionally, an opening 10 is defined between the inner ring mechanism 16 and the main body of the trash receptacle 15 for the purpose of inserting an upper portion of the bag liner when the bag is inserted within the receptacle. FIGS. 11 and 12 show a portion of the inner ring mechanism 16 utilized in trash receptacles having different contours.

Please note that in all of the embodiments, the inner ring is slightly recessed from an upper portion of the trash receptacle. This feature allows for the placement of a cover on the trash receptacle.

Accordingly, the present invention provides for an inner ring mechanism which allows a user to use various size trash bags on an existing trash receptacle, eliminates the overhang of the bag liner on the exterior of the trash bag, and eliminates air pocketing when the bag liner is placed within the trash receptacle.

Obviously, numerous modifications and variations of the present invention are possible in light of the above teachings. It is therefore to be understood that within the scope of the appendant claims, the invention may be practiced otherwise then as specifically described herein.

What is claimed as new and desired to be secured by Letters Patent of the United States is:

1. An inner ring mechanism for supporting a flexible bag liner inside a trash receptacle, said trash receptacle having a main body with a closed bottom and an open top with a rim, said inner ring comprising:

means for mounting said inner ring on said rim of said receptacle, wherein said inner ring is disposed within an upper portion of said receptacle and has a diameter slightly smaller than the diameter of said receptacle; and a plurality of flared portions defined on predetermined positions along the circumference of the inner ring, wherein gaps for venting air are disposed along the circumference of the inner ring between said flared portions, thereby enabling a release of trapped air upon insertion of said flexible bag liner into said receptacle, said flared portions extending outwardly toward the main body of said receptacle;

wherein an opening is defined between said inner ring and said mounting means, such that a top portion of said bag liner can be inserted within said opening when said inner ring is mounted within said receptacle and said bag liner is inserted into said trash receptacle, thereby supporting said bag liner and preventing the bag liner from overhanging on the exterior of the receptacle;

said inner ring further comprising means for selectively adjusting a circumferential size of the inner ring, wherein said means for selectively adjusting the circumferential size of the inner ring comprises a full length slit in said inner ring which defines selectively overlapping longitudinal edges of said inner ring, one of said overlapping edges of said inner ring comprising a plurality of slots, the other of said overlapping edges of said inner ring comprising a plurality of protruding snap means, said snap means being selectively insertable into said slots to define different circumferential sizes of said inner ring, whereby said inner ring can be adapted to receptacles of various sizes.

2. An inner ring mechanism as claimed in claim 1, wherein said mounting means comprise hook means for hooking onto the rim of said receptacle when said inner ring is mounted within said receptacle.

3. An inner ring mechanism as claimed in claim 2, wherein said flared portions abut against the main body of said receptacle when said inner ring is mounted with said receptacle to provide for added stability.

* * * * *